US009392370B2

(12) United States Patent
Takada

(10) Patent No.: US 9,392,370 B2
(45) Date of Patent: Jul. 12, 2016

(54) VOICE COIL SPEAKER

(71) Applicant: CLARION CO., LTD., Saitama-shi, Saitama (JP)

(72) Inventor: Naoki Takada, Saitama (JP)

(73) Assignee: CLARION CO., LTD., Saitama (JP)

( * ) Notice: Subject to any disclaimer, the term of this patent is extended or adjusted under 35 U.S.C. 154(b) by 0 days.

(21) Appl. No.: 14/408,906

(22) PCT Filed: May 31, 2013

(86) PCT No.: PCT/JP2013/065147

§ 371 (c)(1),
(2) Date: Dec. 19, 2014

(87) PCT Pub. No.: WO2014/002680

PCT Pub. Date: Jan. 3, 2014

(65) Prior Publication Data

US 2016/0014524 A1 Jan. 14, 2016

(30) Foreign Application Priority Data

Jun. 26, 2012 (JP) ..... 2012-142875

(51) Int. Cl.
*H04R 9/00* (2006.01)
*H04R 9/04* (2006.01)
(Continued)

(52) U.S. Cl.
CPC ..... *H04R 9/045* (2013.01); *H04R 1/06* (2013.01); *H04R 7/20* (2013.01); *H04R 31/006* (2013.01); *H04R 2499/13* (2013.01)

(58) Field of Classification Search
CPC .... H04R 9/00; H04R 29/003; H04R 2209/00; H04R 2209/41
USPC ..... 381/396, 398, 400–402, 404, 407–410
See application file for complete search history.

(56) References Cited

U.S. PATENT DOCUMENTS 4,539,442 A * 9/1985 Puls ..... H04R 9/045 381/408
6,421,449 B1 * 7/2002 Hasegawa ..... H04R 9/046 381/401

(Continued)

FOREIGN PATENT DOCUMENTS

EP 0836362 A2 4/1998
GB 2062408 A 5/1981

(Continued)

OTHER PUBLICATIONS

International Search Report PCT/JP2013/065147 dated Aug. 27, 2013.

(Continued)

*Primary Examiner* — Suhan Ni
(74) *Attorney, Agent, or Firm* — McDermott Will & Emery LLP

(57) ABSTRACT

A voice coil speaker in which signal lines are properly designed and deterioration of sound quality is suppressed is provided. A voice coil speaker 1 has a diaphragm supported by a frame, and a bobbin which is connected to the diaphragm and has voice coils formed thereon. The bobbin has a bobbin main portion having the voice coils wound therearound, and an extension portion which extends from the bobbin main portion and has signal lines conducted to the voice coils, the bobbin main portion and the extension portion are integrally formed of a flexible printed board, and the extension portion is placed to extend at the back side of the diaphragm.

8 Claims, 13 Drawing Sheets

(51) Int. Cl.

| | |
|---|---|
| ***H04R 7/20*** | (2006.01) |
| ***H04R 1/06*** | (2006.01) |
| *H04R 31/00* | (2006.01) |

(56) References Cited

U.S. PATENT DOCUMENTS

| | | | | |
|---|---|---|---|---|
| 7,447,327 | B2 * | 11/2008 | Kitamura | H04R 1/06 381/409 |
| 7,697,712 | B2 * | 4/2010 | Sung | H01Q 1/243 381/409 |
| 8,594,363 | B2 * | 11/2013 | Lee | H04R 9/046 381/400 |

FOREIGN PATENT DOCUMENTS

| | | | |
|---|---|---|---|
| JP | 62-150999 | A | 7/1987 |
| JP | 63-49895 | U | 4/1988 |
| JP | 63-215296 | A | 9/1988 |
| JP | 4-36400 | U | 3/1992 |
| JP | 2000-287296 | A | 10/2000 |
| JP | 2010-028785 | A | 2/2010 |
| JP | 2012-015874 | A | 1/2012 |

OTHER PUBLICATIONS

Office Action Japanese Patent Application No. 2014-522494 dated Dec. 22, 2015 with full English translation.

Supplementary European Search Report EP Application No. 13808566.7 dated Jan. 27, 2016.

* cited by examiner (B)

(A)

VOICE COIL SPEAKER

CROSS-REFERENCE TO RELATED APPLICATIONS

This Application is the U.S. National Phase of PCT/JP2013/065147 filed May 31, 2013, which claims priority from Japanese Patent Application No. 2012-142875 filed Jun. 26, 2012. The subject matter of each is incorporated herein by reference in entirety.

TECHNICAL FIELD

The present invention relates to a voice coil speaker having a voice coil formed on a bobbin.

BACKGROUND ART

A voice coil speaker in which a bobbin having a voice coil formed thereon is coaxially connected to a diaphragm (see Patent Document 1, for example). In this type of voice coil speaker, a circuit board for processing audio signals is connected to the voice coil through a signal line for outputting a driving signal.

PRIOR ART DOCUMENT

Patent Document

Patent Document 1: JP-A-2010-28785

SUMMARY OF THE INVENTION

Problem to be Solved by the Invention

However, there is a case where motion of the bobbin is disturbed by the signal line in the conventional voice coil speaker. Particularly, in a voice coil speaker having multilayered voice coils, plural signal lines for outputting driving signals exist in accordance with the number of voice coils, and thus there is a case where the signal lines interfere with one another or the motion of the bobbin is disturbed by the plural signal lines. In such a case, sound quality of sounds output from the voice coil speaker is deteriorated, and it is necessary to properly design the signal lines.

The present invention has been implemented in view of the foregoing situation, and has an object to provide a voice coil speaker that properly designs signal lines and suppresses deterioration of sound quality.

Means of Solving the Problem

In order to attain the above object, a voice coil speaker comprises: a diaphragm supported by a frame; and a bobbin that is connected to the diaphragm and has voice coils formed thereon, wherein the bobbin has a bobbin main portion having the voice coils wound therearound, and an extension portion that extends from the bobbin main portion and has signal lines conducted to the voice coils, and the bobbin main portion and the extension portion are integrally formed of a flexible printed board so that the extension portion is placed to extend at aback side of the diaphragm.

In the present invention, a fulcrum for movement of the extension portion is disposed at the frame, and the extension portion that is placed to extend at the back side of the diaphragm is connected to the fulcrum for movement.

In the present invention, the fulcrum for movement is a connector for connection of a circuit board that processes audio signals.

In the present invention, the diaphragm is connected to a tip of the bobbin main portion, the extension portion is made to extend from the tip, the bobbin main portion is provided with cutout portions formed at both the sides of abase portion of the extension portion, and the extension portion is bent from the cutout portions so as to extend at the back side of the diaphragm.

In the present invention, the length of the cutout portions is set to a length that enables the extension portion to avoid a connection portion between the base end portion of the diaphragm and the bobbin main portion.

In the present invention, a reinforcing member is equipped at a site corresponding to at least the cutout portions of the bobbin main portion.

In the present invention, the diagram is connected to a tip of the bobbin main portion, the extension portion is equipped to the tip, a through-hole is formed in the diaphragm, and the extension portion is configured to penetrate from a front side of the diaphragm through the through-hole and extend to a back side of the diaphragm.

In the present invention, the extension portion is fixed along a back surface of the diaphragm.

In the present invention, a plurality of extension portions are equipped, and the plurality of extension portions are equipped at symmetrical positions with respect to a center axis of the bobbin.

In the present invention, a plurality of extension portions are equipped, and the plurality of extension portions are equipped at equidistance intervals in the peripheral direction of the bobbin.

In the present invention, the extension portion is equipped with a shield.

Effect of the Invention

According to the present invention, the extension portion is formed of the flexible printed board, so that the extension portion can be restrained from disturbing the vibration of the bobbin main portion, and the deterioration of sound quality can be prevented. Furthermore, the extension portion is made to extend at the back side of the diaphragm, and thus it is unnecessary to dispose the circuit board for processing audio signals at the front surface of the diaphragm, so that the deterioration of the sound quality can be prevented.

MODES FOR CARRYING OUT THE INVENTION

Embodiments according to the present invention will be described hereunder with reference to the accompanying drawings.

First Embodiment

Figure 1:
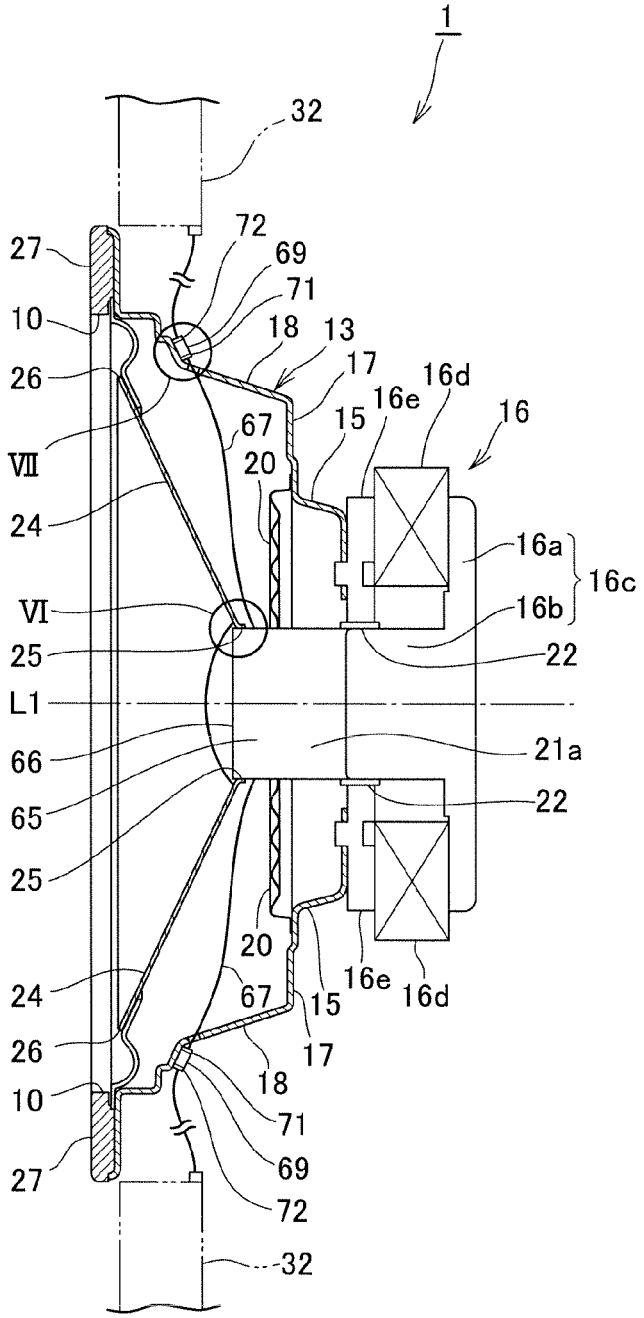
FIG. 1 is a cross-sectional view showing a voice coil speaker according to a first embodiment of the present invention.

FIG. 1 is a cross-sectional view showing a voice coil speaker 1 according to a first embodiment. In FIG. 1, the center axis of the voice coil speaker is represented by reference character L1.

The voice coil speaker 1 according to the embodiment is secured to the side surface of a door of a vehicle, for example, and it is a speaker which is supplied with a digital audio signal from an in-vehicle mount audio device and outputs sounds on the basis of the digital audio signal.

As shown in FIG. 1, the voice coil speaker 1 has a cylindrical speaker frame 13 which has a bottom and also has a circular speaker opening 10 formed at the front surface thereof.

A bowl-shaped frame rear portion 15 which decreases in diameter toward the front side thereof and has a circular opening formed at the front surface thereof is formed at the rear portion of the speaker frame 13, and a magnetic circuit unit (driving mechanism) 16 for driving a speaker main body 11 is provided at the rear side of the frame rear portion 15.

The magnetic circuit unit 16 has a yoke 16*c* having a disc-shaped yoke bottom portion 16*a*, and a columnar yoke convex portion 16*b* which projects forwards at the center portion of the yoke bottom portion 16*a*. An annular magnet 16*d* is fixed to the front surface of the yoke bottom portion 16*a* so as to surround the yoke convex portion 16*b*, and an annular plate 16*e* is fixed at the front side of the magnet 16*d*. A magnetic gap (not shown) is formed between the outer periphery of the yoke convex portion 16*b* and the inner periphery of the plate 16*e*, and a bobbin 21*a* and a voice coil 22 formed by winding a tinsel (lead wire) on the bobbin 21*a* are disposed in the magnetic gap.

Furthermore, the speaker frame 13 has an annular frame flat portion 17 which is formed to be coaxial with the center axis L1 of the voice coil speaker 1 and extend outwards from the edge of a circular opening formed at the front surface of the frame rear portion 15 along the peripheral direction of the opening. The base end of a cylindrical frame cylinder portion 18 which decreases in diameter toward the front side and has a circular speaker opening 10 at the front surface thereof is connected to the outer periphery of the frame flat portion 17.

A damper 20 is connected to the edge of the circular opening formed at the front surface of the frame rear portion 15 so as to block the opening, and the cylindrical bobbin 21*a* extending coaxially with the center axis L1 of the voice coil speaker is supported at the center of the damper 20, whereby the bobbin 21*a* is supported and fixed to the speaker frame 13. The damper 20 and the bobbin 21*a* are coaxially arranged so that the center axes thereof are coincident with the center axis L1 of the voice coil speaker 1.

Figure 2:
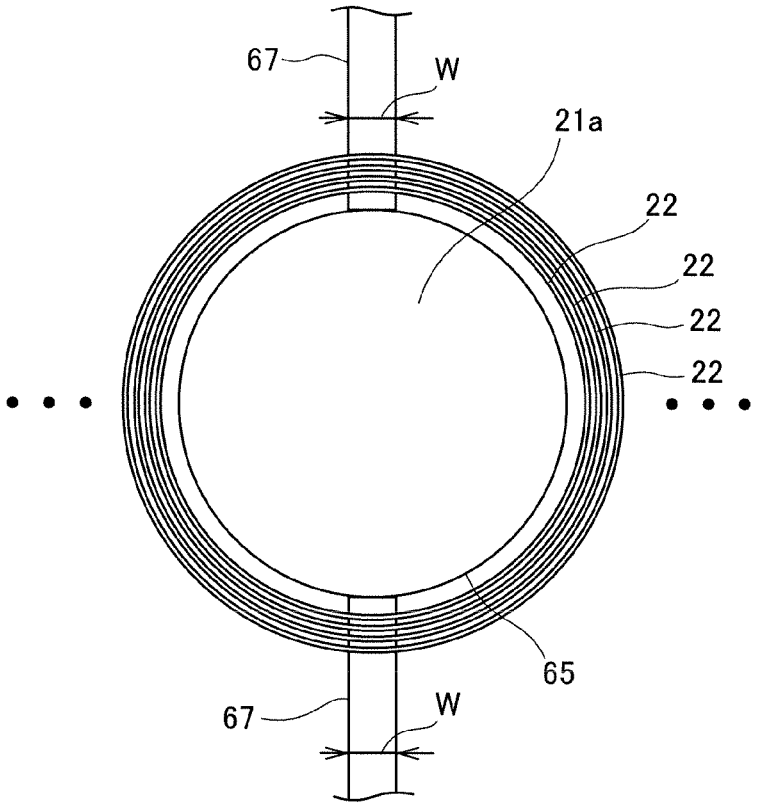
FIG. 2 is a top view of a bobbin having a voice coil thereon.

FIG. 2 is a view showing the bobbin 21*a* when the bobbin 21*a* is viewed from the lower side. In FIG. 2, the bobbin 21*a* and the voice coil 22 are schematically illustrated while the shapes of the bobbin 21*a* and the voice coil 22 are simplified to clarify the relationship between the bobbin 21*a* and the voice coil 22.

As shown in FIG. 2, the bobbin 21*a* holds plural voice coils 22 each of which is formed by winding a lead wire formed of a wire rod such as a copper wire or the like is regularly wound in the axial direction of the bobbin 21*a*. In this embodiment, the plural voice coils 22 are provided to be stacked and form a multilayer in the peripheral direction of the bobbin 21*a*. Each layer of voice coils 22 is electrically connected to an audio signal processing circuit board 32 described later, and each layer of voice coils 22 vibrates the bobbin 21*a* on the basis of a driving signal input from the audio signal processing circuit board 32.

Referring to FIG. 1, a base end portion 25 of a conical diaphragm 24 which decreases in diameter toward the front side is connected to the tip 66 of the bobbin 21*a* coaxially with the center axis L1 of the voice coil speaker 1, and the outer periphery of the tip portion 26 of the diaphragm 24 is connected to the inner periphery of the speaker opening 10 formed at the front surface of the frame cylinder portion 18 of the speaker frame 13. The diaphragm 24 vibrates in accordance with vibration of the bobbin 21*a* caused by the multilayered voice coils 22, and sounds are output on the basis of the vibration of the diaphragm 24.

The outer periphery of the speaker opening 10 formed at the front surface of the frame cylinder 18 is provided with an annular frame flange 27 extending outwards from the edge of the periphery concerned along the peripheral direction of the opening, and plural screw holes (not shown) are formed in the frame flange 27. When the voice coil speaker 1 is fixed to the side surface of a door of a vehicle, the voice coil speakers 1 are screwed to the door through the screw holes (not shown).

Here, the audio signal processing circuit board 32 will be described in detail.

External equipment serving as an audio signal output source such as an in-vehicle mount audio device or the like is connected to the audio signal processing circuit board 32, and the audio signal processing circuit board 32 is a digital circuit board on which a circuit for subjecting input digital audio signals to various kinds of digital processing to generate and output driving signals for the respective layers of voice coils 22 is mounted.

More specifically, circuits such as a $\Delta\Sigma$ modulation circuit, various kinds of filter circuits, a digital amplifier, etc. are mounted on the audio signal processing circuit board 32. The audio signal processing circuit board 32 executes signal processing such as predetermined sampling processing, predetermined filtering processing, etc. on multi-channel audio signals input from external equipment connected to the audio signal processing circuit board 32 to generate a driving signal to be output to each voice coil 22 and output the generated driving signal to each voice coil 22. The bobbin 21*a* vibrates in accordance with the driving signal input from the audio signal processing circuit board 32 to each voice coil 22, and in connection with this vibration, the diaphragm 24 vibrates and sounds are output.

Here, each circuit mounted on the audio signal processing circuit board 32 is a digital circuit, and thus the audio signal processing circuit may be remarkably smaller in size than that constructed by analog circuits. Particularly, the digital amplifier is extremely more compact than an analog amplifier.

As described above, according to this embodiment, in the audio signal processing circuit board 32, a driving signal to be output to each voice coil 22 is generated, and the generated driving signal is output to each voice coil 22. Therefore, it is necessary to provide plural signals lines for driving signals in accordance with the number of layers of voice coils 22 (six layers in this embodiment). At this time, it is required to prevent interference among the plural signal lines to suppress deterioration of sound quality, and also it is also required to prevent the motion of the bobbin 21*a* from being disturbed by the signal lines.

According to this embodiment, the members such as the bobbin 21*a*, the signal lines, etc. are configured as follows in consideration of the above matters.

Figure 3:
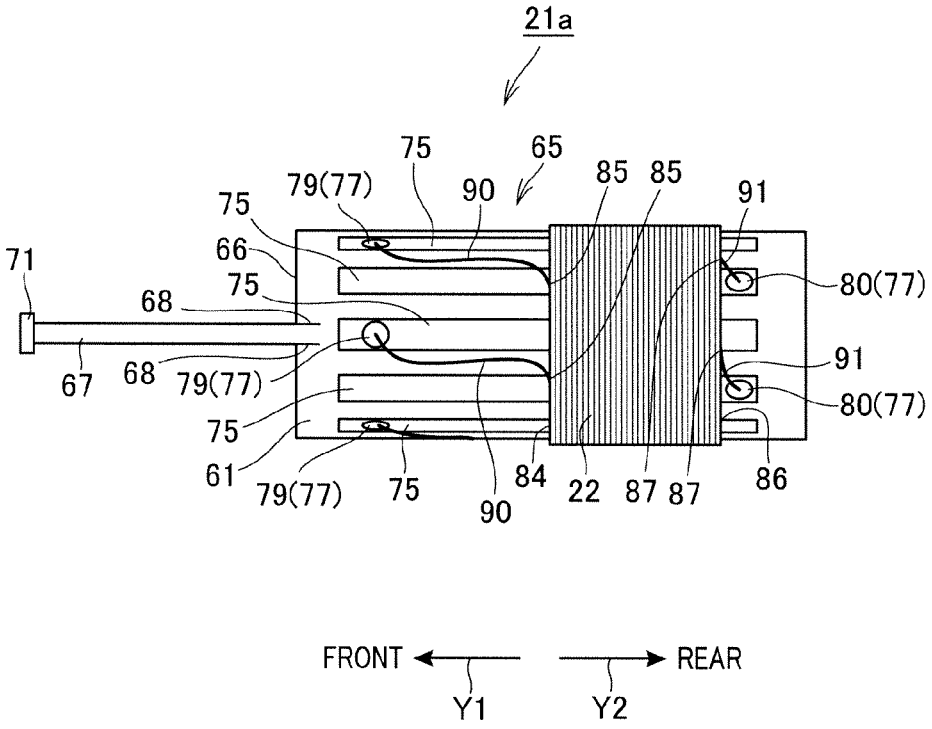
FIG. 3 is a side view showing the bobbin.
Figure 4:
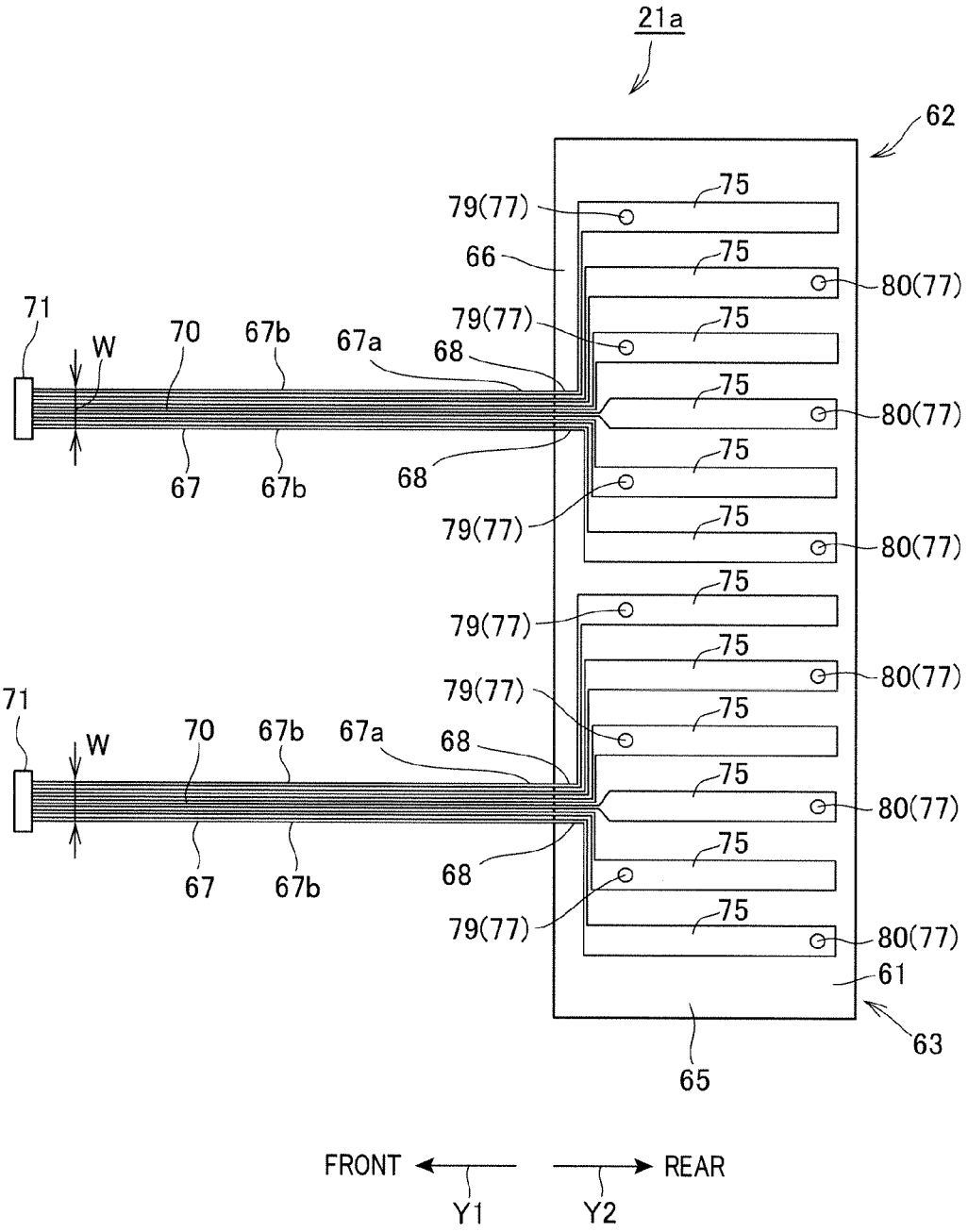
FIG. 4 is a diagram showing a bobbin before the bobbin is molded in a cylindrical shape.
Figure 5:
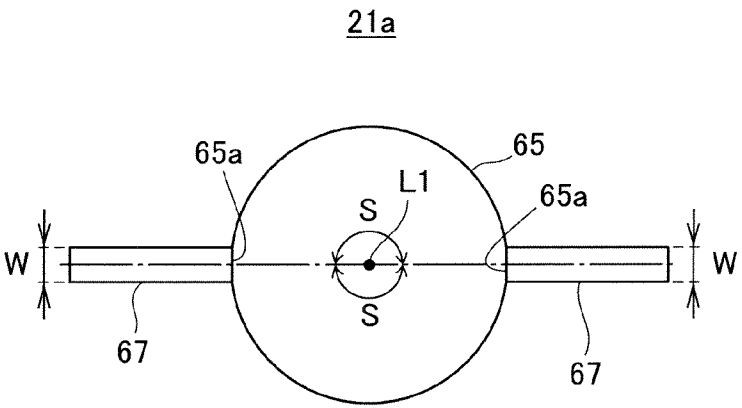
FIG. 5 is a front view showing the bobbin, wherein (A) shows a bobbin having one signal line portion, and (B) shows a bobbin having two signal line portions.
Figure 5:
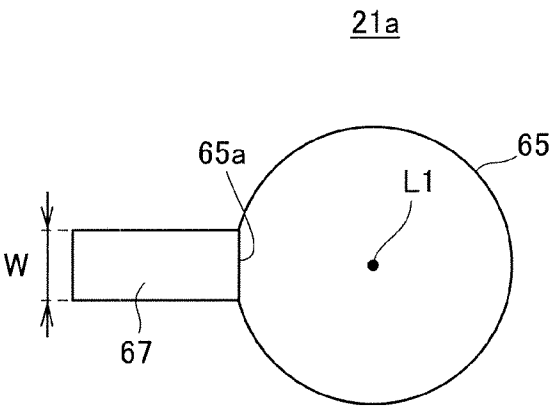

FIG. 3 is a side view showing the bobbin 21*a* under the state that the voice coils 22 are wound around the bobbin 21*a*, and FIG. 4 is a diagram showing the bobbin 21*a* before it is molded in a cylindrical shape. In the bobbin 21*a* shown in FIG. 4, the bobbin 21*a* is rolled so that the surface 61 as a surface at which contact points 77 are exposed becomes an outer surface of the cylinder, and one end connection portion 62 and the other end connection portion 63 are joined to each other by a method such as adhesion or the like, thereby forming the cylindrical voice coils 22 shown in FIG. 3. FIG. 5 is a front view showing the bobbin 21*a*, wherein FIG. 5(A) shows the bobbin 21*a* provided with one signal line portion 67, and FIG. 5(B) shows the bobbin 21*a* provided with two signal line portions 67.

In FIGS. 3 and 4, the front-and-rear direction is defined as shown by arrows in FIGS. 3 and 4. That is, the direction indicated by an arrow Y1 is a frontward direction, and the direction indicated by an arrow Y2 is a rearward direction.

As shown in FIG. 4, the bobbin 21 before it is formed in a cylindrical shape has a bobbin main portion which is rectangular in front view, and two signal line portions (extension portions) which are designed to be slender in the frontward direction extend from a part of the tip 66 extending in the longitudinal direction of the bobbin main portion 65. The bobbin main portion 65 is rolled and the one end connection portion 62 and the other end connection portion 63 are joined to each other, whereby the bobbin main portion 65 is formed as a cylindrical barrel portion. The two signal line portions 67 are equipped to be located symmetrically with respect to the center axis L1 (FIG. 1) so as to face each other when the bobbin main portion 65 is formed in a cylindrical shape. In other words, the two signal line portions 67 are equipped at equal intervals S in the peripheral direction of the bobbin main portion 65.

In this embodiment, the bobbin main portion 65 and the signal line portions 67 are formed integrally with each other by a flexible printed board.

The signal line portion 67 of the bobbin 21*a* and the bobbin main portion 65 will be described in detail.

The signal line portion 67 is a flexible printed board, and plural signal line conductors 70 are formed and patterned as a signal line for driving signals to be output from the audio signal processing circuit board 32 to the voice coils 22. Particularly, in this embodiment, the flexible printed board is FPC having double-sided shields, and configured so that radiation noise caused by digital signals is reduced. It is preferable that at least the signal line portion 67 as the extension portion is constructed by FPC having double-sided shields. The configuration enables reduction of radiation noise caused by digital signals with respect to the signal line conductors 70.

The respective signal line conductors 70 are linear conductors, and arranged in the signal line portion 67 so as to be spaced from one another at predetermined intervals along the signal line portion 67. The signal line conductor 70 is a conductive member formed of thin film of metal such as copper or the like, and sandwiched by films having insulation properties such as polyimide film, photo-soldering resist film or the like, whereby the signal line conductor 70 can be kept insulated from the other signal line conductors 70 and the outside, and protected from physical contact.

In this embodiment, the six layers of voice coils 22 are formed on the bobbin 21. Therefore, twelve signal lines, as a whole, are required to be connected to the voice coils 22, respectively.

Six signal line conductors 70 which correspond to the half of the twelve signal lines are formed in each signal line portion 67.

A signal line connector 71 is provided to the tip of the signal line portion 67. The signal line connector 71 is a connector to be connected to a circuit-board side connector 72 (FIG. 1) equipped to the audio signal processing circuit board 32, and the signal line connector 71 and the circuit-board side connector 72 are connected to each other, thereby establishing the connection between the audio signal processing circuit board 32 and the signal line conductors 70 formed in the signal line portion 67, which enables the driving signals to be output from the audio signal processing circuit board 32 through the signal line conductors 70 to the voice coils 22.

As shown in FIG. 1, when the signal line connector 71 is connected to the circuit-board side connector 72, the tip 66 of the bobbin main portion 65 and the audio signal processing circuit board 32 are set to be physically connected to each other through the signal line portion 67.

Here, the bobbin 21*a* is a member which vibrates with being accompanied by output of sounds from the voice coil speaker 1. Therefore, the signal line portion 67 is provided with a slack portion (tolerance portion) in consideration of the stroke amount of the bobbin 21*a*, whereby smooth vibration of the bobbin 21*a* can be prevented from being disturbed by the signal line portions 67.

As described above, in this embodiment, the bobbin 21*a* (bobbin main portion 65) and the connector 69 as an action fulcrum are connected to each other through the signal line portion 67 constructed by the flexible printed board, and further the audio signal processing circuit board 32 and each of the voice coils 22 are electrically connected to each other through the signal line conductors 70 formed in the signal line portion 67.

The construction described above brings the following effect.

That is, the flexible printed board has a characteristic that it is thin and excellent in flexibility. Therefore, even when the connector 69 as an action fulcrum and the bobbin main portion 65 are set to a physically connected state through the signal line portion 67 (the state shown in FIG. 1), the vibration of the bobbin 21*a* can be prevented from being disturbed by the signal line portion 67, and deterioration of sound quality can be prevented. Particularly, in this embodiment, it is necessary to connect the twelve signal lines from the audio signal processing circuit board 32 to the voice coils 22 of the bobbin 21*a*. However, when the voice coil speaker is configured so that twelve tinsel wires extend from the audio signal processing circuit board 32 to the bobbin 21*a*, it is required to strictly design the thickness, arrangement, etc. of the tinsel wires in consideration of the strength of the tinsel wires and fulfillment of smooth vibration of the bobbin 21*a*. However, in this embodiment, the smooth vibration of the bobbin 21*a* can be easily and surely secured by using the signal line portion 67 as the flexible printed board.

It is required that the respective signal lines connected to the voice coils 22 do not electrically interfere with one another to prevent deterioration of the sound quality. In this embodiment, the signal line portion 67 is a flexible printed board, so that the insulation state of the signal lines (signal line conductors 70) can be surely secured, and the electrical interference of the signal lines can be surely prevented. Particularly, the signal lines are connected to the voice coils 22 wound around the bobbin 21*a*. The vibration of the bobbin 21*a* which is accompanied by output of sounds is necessarily transmitted through the signal lines. However, even when the bobbin 21*a* vibrates, there is no possibility that the respective signal lines interfere with one another. Furthermore, since each of the signal lines (signal line conductors 70) is constructed by a conductive member which is formed on the flexible printed board by print formation, occurrence of such a situation that the signal lines are broken in connection with vibration of the bobbin 21*a* can be prevented as much as possible.

The signal line portion 67 is constructed by the flexible printed board, and when each of the twelve signal lines (the signal line conductors 70 formed in the signal line portion 67) is electrically connected to the audio signal processing circuit board 32, the connector 71 for the signal lines of the signal line portion 67 and the circuit-board side connector 72 may be connected to each other. Therefore, the voice coil speaker 1 can be very easily manufactured. This effect is more effective as compared with a case where each of the twelve signal lines is formed of a tinsel wire and the audio signal processing circuit board 32 is connected to the voice coils 22 through the respective tinsel wires.

Furthermore, in this embodiment, in consideration of the characteristic that the six layers of voice coils 22 are formed on the bobbin 21*a* and the signal line is connected to each voice coil 22, to put it simply, current flowing in each signal line is reduced to one sixth as compared with a case where one layer of voice coils 22 is formed. That is, the current flowing in each signal line is very small. Therefore, the width of the signal line conductor 70 can be narrowed in the signal line portion 67, resulting in that the width of the signal line portion 67 itself can be reduced. Accordingly, the bendability and flexibility of the signal line portion 67 as the flexible printed board can be enhanced more greatly, and the deterioration of the sound quality can be more greatly prevented.

Furthermore, in this embodiment, the two signal line portions 67 extend from the bobbin main portion 65, and each of the two signal line portions 67 is provided with six signal lines, that is, totally twelve signal lines are provided. Therefore, as compared with the case where one signal line portion 67 is provided, the load imposed on the bobbin main portion 65 from the signal line portion 67 is distributed more greatly and thus the bobbin main portion 65 vibrates smoothly, whereby the sound quality can be prevented from being deteriorated by the signal line portion 67.

Furthermore, the two signal line portions 67 are equipped symmetrically with respect to the center axis L1 as the boundary, that is, they are disposed at equal intervals S in the peripheral direction of the bobbin main portion 65. Therefore, as compared with the case where one signal line portion 67 is provided, an uneven load is more greatly suppressed from being applied to the bobbin main portion 65 due to the signal line portion 67, and the load can be applied from the signal line portions 67 to the bobbin main portion 65 with excellent balance, so that the bobbin main portion 65 can vibrate smoothly and the sound quality can be prevented from being deteriorated by the signal line portion 67. Particularly, in this embodiment, the signal line portion 67 is supported by only the connector 71 for the signal lines at the tip of the base portion 67, and the whole weight of the signal line portion 67 itself is applied to the bobbin main portion 65. Accordingly, by arranging the two signal line portions 67 at equal intervals S in the peripheral direction of the bobbin main portion 65, the loads from the signal line portions 67 are applied to the bobbin main portion 65 substantially equally, so that the effect of preventing the sound-quality deterioration caused by the signal line portions 67 is remarkable.

Furthermore, when plural signal line conductors 70 are equipped to the signal line portion 67, the bobbin main portion 65 at a site from which the signal line portion 67 extends becomes relatively lower in bendability and flexibility. Therefore, as shown in FIG. 5(A), in a case where only one signal line portion 67 is provided, when the bobbin main portion 65 is rolled to be designed in a cylindrical shape, there is a tendency that the site 65*a* of the bobbin main portion 65 from which the signal line portion 67 extends is not along the circular shape, but becomes linear.

On the other hand, since the two signal line portions 67 are provided as shown in FIG. 5(B) in this embodiment, the width W of each signal line portion 67 is smaller and thus higher bendability and flexibility can be secured for the signal line portion 67 as compared with the case where one signal line portion 67 is provided. In addition, the site 65*a* which becomes linear in the bobbin main portion 65 becomes small, and the rolled bobbin main portion 65 can be made close to a perfect circle. Therefore, the vibration of the bobbin 21*a* can be substantially uniformly transmitted in the peripheral direction of the diaphragm 24, and the deterioration of the sound quality can be prevented.

Next, the bobbin main portion 65 will be described in detail.

The bobbin main portion 65 is constructed by a flexible printed board, and twelve bobbin conductors 75 which extend in the front-and-rear direction and are formed of thin film of metal such as copper or the like are pattern-formed to be arranged at substantially the same interval. Each of the bobbin conductors 75 is sandwiched by film having insulating properties such as polyimide film, photosolder resist film or the like, and kept insulated from the other bobbin conductors 75 and the outside, and also protected from physical contact. Particularly, in this embodiment, the flexible printed board is FPC having double-sided shields, and radiation noise caused by digital signals is reduced.

As described above, according to this embodiment, the signal line portions 67 and the bobbin main portion 65 are formed integrally with each other by one flexible print board. Therefore, as compared with a case where the signal line portion 67 and the bobbin main portion 65 are respectively formed of individual members, a step of connecting the signal line portion 67 and the bobbin main portion 65, etc. are unnecessary, and thus the manufacturing of the voice coil speaker 1 can be more greatly facilitated. Particularly, the respective signal line conductors 70 formed on the signal line portion 67 and the bobbin conductors 75 formed on the bobbin main portion 65 are integrally pattern-formed by the same conductive member. Therefore, the facilitation of the manufacturing can be enhanced while surely maintaining the conductive state of these conductors.

A contact point 77 which is formed by exposing each bobbin conductor 75 to the surface 61 is equipped on the surface 61 of the bobbin main portion 65 in connection with each bobbin conductor 75. In this embodiment, twelve bobbin conductors 75 are formed on the bobbin main portion 65, and each contact point 77 is formed on each bobbin conductor 75, and totally twelve contact points 77 are formed.

The contact points 77 contain two types of contact points formed at the front portions of the bobbin conductors 75 (hereinafter referred to as "winding start connecting contact points 79", and contact points at the rear portions of the bobbin conductors 75 (hereinafter referred to as "winding end connecting contact points 80", and these contact points 77 are alternately arranged in accordance with the arrangement of the bobbin conductors 75.

One voice coil 22 out of the voice coils 22 of the six layers, the relationship between the winding start connecting contact point 79 and the winding end connecting contact points 80 corresponding to the voice coil 22 and the detailed constructions of these members will be described hereunder.

As shown in FIG. 3, the voice coil 22 is constructed by winding a lead wire around the bobbin main portion 65. In this embodiment, each of all the voice coils 22 is formed by singularly winding a lead wire from a winding start portion 85 at a front end edge 84 thereof (a site at which the winding of the lead wire is started) to a winding end portion 86 at a rear end edge 86 thereof formed behind the front end edge 84 (a site at which the winding of the lead wire is finished). A pre-winding lead wire 90 which corresponds to a lead wire before winding extends from the winding start portion 85, and a post-winding lead wire 91 which corresponds to a lead wire after winding extends from the winding end portion 87.

The voice coil 22 is formed between the winding start connecting contact point 79 and the winding end connecting contact point 80 on the bobbin main portion 65. The pre-winding lead wire 90 extending from the winding start portion 85 of the voice coil 22 is connected (conducted) to the corresponding one winding start connecting contact point 79 by a means such as soldering or the like, and also the post-winding lead wire 91 extending from the winding end portion 87 is connected (conducted) to the corresponding one winding end connecting contact point 80. Accordingly, the following sequential electrical connection is established: the audio signal processing circuit board 32→the signal line conductor 70→the bobbin conductor 75→the winding start connecting contact point 79→the pre-winding lead wire 90→voice coil 22→post-winding lead wire 91→winding end connecting contact point 80→the bobbin conductor 75→the signal line conductor 70→the audio signal processing circuit board 32, whereby a driving signal can be output from the audio signal processing circuit board 32 to the voice coil 22.

In this embodiment, as shown in FIG. 1, the base end portion 25 of the diaphragm 24 is fixed to the tip 26 side of the bobbin main portion 65 on the surface 61 as the outer peripheral surface of the bobbin main portion 65, and the signal line portion 67 is placed at the tip 66 of the bobbin main portion 65, so that the signal line portion 67 would be located at the front side of (in front of) the diaphragm 24 without any modification. Accordingly, the audio signal processing circuit board 32 to be connected to the signal line portion 67 is required to be disposed at the front side of the diaphragm 24.

However, from the acoustic viewpoint, it is not desirable to arrange the parts such as the audio signal processing circuit board 32, the signal line portion 67, etc. at the front side of the diaphragm 24. Furthermore, when the parts such as the audio signal processing circuit board 32, the signal line portion 67, etc. are arranged at the front side of the diaphragm 24, there would be a disadvantage that the signal line port ion 67, etc. themselves vibrate and produce unnecessary sounds. Therefore, according to this embodiment, the signal line portion 67 is configured to extend at the back side of (behind) the diaphragm 24.

The construction that the signal line portion 67 is configured to extend at the back side of the diaphragm 24 will be described in detail with reference to FIGS. 3, 6 and 7.

Figure 6:
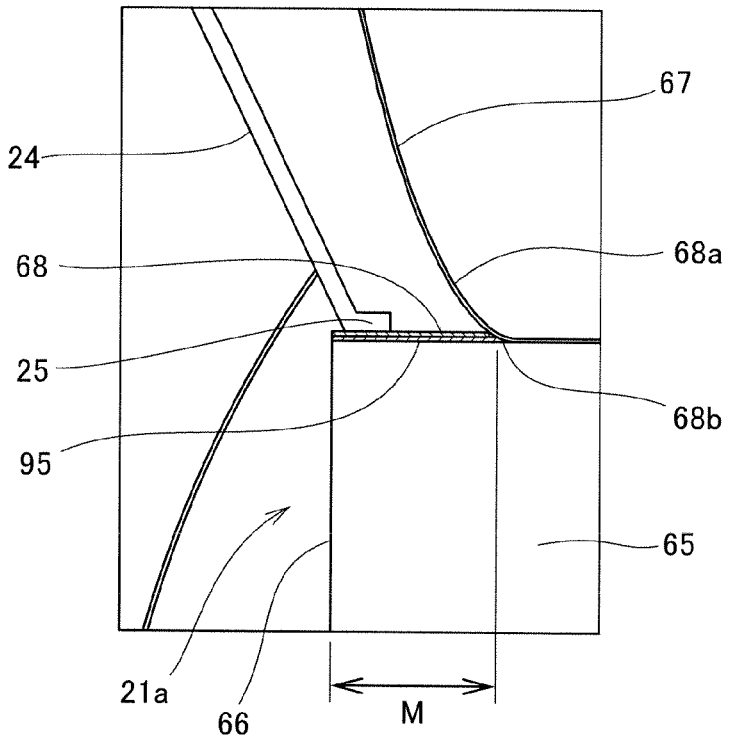
FIG. 6 is a main-part enlarged view showing an enlarged range VI of FIG. 1.

FIG. 6 is a main-part enlarged view showing an enlarged range VI of FIG. 1. FIG. 7 is a main-part enlarged view showing an enlarged range VII of FIG. 1.

As shown in FIG. 3, cutout portions 68 are formed at both the sides of the base portion 67*a* (FIG. 4) side of the signal line portion 67 by linearly cutting out the flexible printed board along both the sides 67*b* of the signal line portion 67. The cutout portions 68 are formed at a portion where the bobbin conductors 75 are not formed on the flexible printed board, that is, a portion between the bobbin conductor 75 and the tip 66. The cutout portions 68 of this embodiment are configured to be linear. However, they are not limited to this shape, and may be configured to be curved, for example.

As described above, by forming the cutout portions 68 in the bobbin portion 68, the bobbin main portion 65 in the area surrounded by the two cutout portions 68 can be erected from the bobbin main portion 65 as shown in FIG. 6. The part 68*a* of the bobbin main portion 65 which is surrounded by the two cutout portions 68 forms a part of the signal line portion 67. The length of the cutout portions 68, that is, the length M between the tip 66 of the bobbin main portion 65 and the back-side end 68*b* of the cutout portions 68 is set to a predetermined length which enables the signal line portion 67 to avoid the connection portion between the base end portion 25 of the diaphragm 24 and the bobbin main portion 65.

Accordingly, the signal line portion 67 is made to extend at the back side of the diaphragm 24 by connecting the diaphragm 24 to the bobbin main portion 65 under the state that the signal line portion 67 is bent from the cutout portions 68 to the outside of the bobbin main portion 65.

A reinforcing member 95 is wound in the peripheral direction of the bobbin main portion 65 around the inner surface of the bobbin main portion 65 over at least an area where the cutout portions 68 are formed. In this embodiment, a sheet-shaped reinforcing body (for example, craft paper) is used as the reinforcing member 95, but the shape and material of the reinforcing member 95 may be arbitrarily selected. The tip 66 side of the bobbin main portion 65 which is liable to be deformed due to formation of the cutout portions 68 is reinforced by winding the reinforcing member 95 around the bobbin main portion 65, so that the circular shape of the bobbin main portion 65 is stabilized. Accordingly, the vibration of the bobbin 21*a* is smoothly transferred to the diaphragm 24, and thus degradation of sound quality which is caused by formation of the cutout portions 68 can be suppressed.

As described above, the signal line portion 67 is placed to extend at the back side of the diaphragm 24, whereby it is unnecessary to arrange the parts such as the audio signal processing circuit board 32, the signal line portion 67, etc. at the front side of the diaphragm 24. Therefore, it can be prevented that sounds output from the voice speaker 1 are disturbed and the sound quality thereof is deteriorated. Furthermore, the parts such as the audio signal processing circuit board 32, the signal line portions 67, etc. are not required to be arranged at the front side of the diaphragm 24, so that the parts such as the audio signal processing circuit board 32, the signal line portion 67, etc. themselves are restrained from vibrating and thus unnecessary sounds can be prevented from occurring.

Furthermore, the arrangement position of the audio signal processing circuit board 32 is not limited to the front side of the diaphragm 24, so that the audio signal processing circuit board 32 can be disposed at any position. Accordingly, the audio signal processing circuit board 32 can be configured as another unit separate from the voice coil speaker 1.

Figure 7:
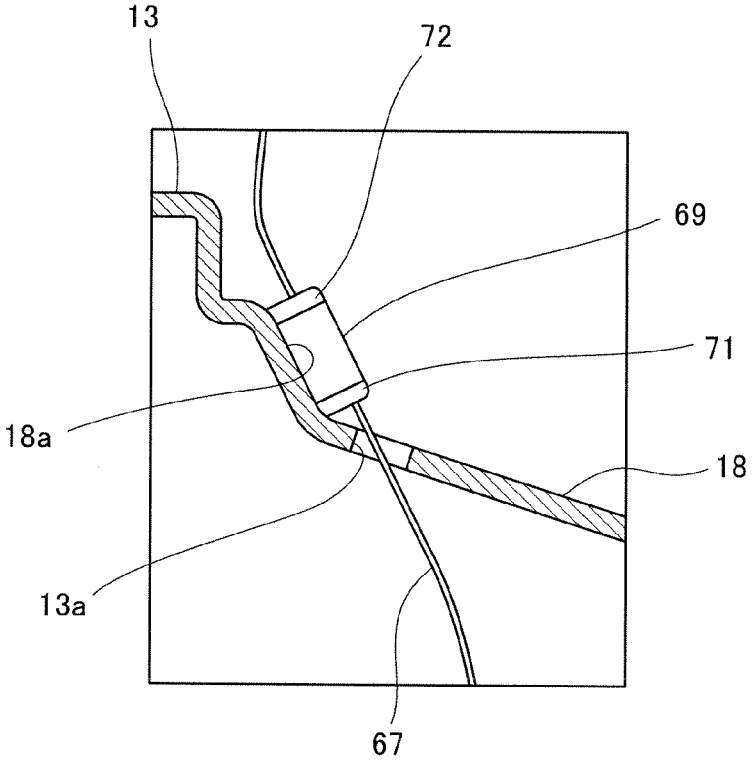
FIG. 7 is a main-part enlarged view showing an enlarged range VII of FIG. 1.

As shown in FIG. 7, an insertion hole 13*a* through which the signal line portion 67 extending at the back side of the diaphragm 24 (FIG. 6) is formed in the speaker frame 13, and also a connector 69 is secured to the outer surface of the speaker frame 13. In this embodiment, the connector 69 is fixed to a recess portion 18*a* equipped to the frame cylinder portion 18, and configured to be prevented from protruding from the speaker frame 13. The connector 69 is a connector through which a connector 71 for signal lines of the signal line portion 67 drawn out from the insertion hole 13*a* to the outside of the speaker frame 13 is connected to a circuit board side connector 72 for the audio signal processing circuit board 32. The signal line connector 71 and the circuit board side connector 72 are connected to each other through the connector 69, thereby performing the electrical connection between the audio signal processing circuit board 32 and the signal line conductors 70 formed in the signal line portion 67.

As described above, the signal line portion 67 and the audio signal processing circuit board 32 are connected to each other through the connector 69, so that the signal line portion 67 and the audio signal processing circuit board 32 can be easily connected to each other. In addition, the connector 69 is disposed at the outside of the speaker frame 13, so that the signal line connector 71 and the circuit board side connector 72 can be easily connected to each other.

Furthermore, since the signal line portion 67 is supported by only the connector 69, no other fixing means for the signal line portion 67 is required. Therefore, the number of parts can be reduced, and the manufacturing process can be simplified.

The signal line portion 67 connected to the connector 69 moves with the connector 69 (the signal line connector 71) serving as a fulcrum for movement (movement fulcrum) when the bobbin main portion 65 vibrates on the basis of a driving signal. Since the connector 69 (signal line connector 71) serving as the movement fulcrum is disposed in the speaker frame 13 as described above, the movement of the signal line portion 67 which is caused by the vibration of the bobbin main portion 65 can be stabilized, and the signal line portion 67 can be prevented from disturbing the vibration of the bobbin main portion 65, so that deterioration of sound quality can be prevented. The length of the signal line portion 67 is set to a proper length at which the signal line portion 67 does not come into contact with the diaphragm 24 when the bobbin main portion 65 vibrates, whereby the vibration of the diaphragm 24 can be prevented from being disturbed by the motion of the signal line portion 67.

As described above, in the voice coil speaker 1 according to this embodiment, the bobbin 21*a* has the bobbin main portion 65 having the voice coils 22 wound therearound, and the signal line portion 67 having the signal lines which extend from the bobbin main portion 65 and are conducted to the voice coils 22, the bobbin main portion 65 and the signal line portions 67 being integrally formed of the flexible printed board. According to this construction, the signal line portion 67 is formed of the thin flexible print board having excellent flexibility, so that the signal line portion 67 can be prevented from disturbing the vibration of the bobbin main portion 65, and the deterioration of the sound quality can be prevented.

Furthermore, in this embodiment, the signal line portion 67 is made to extend at the back side of the diaphragm 24, and thus it is unnecessary to dispose the audio signal processing circuit board 32 at the front side of the diaphragm 24, and the deterioration of the quality of sounds from the voice coil speaker 1 can be prevented.

Still furthermore, in this embodiment, the movement fulcrum for the signal line portion 67 is placed at the speaker frame 13, and the signal line portion 67 is connected to the movement fulcrum, so that the movement of the signal line portion 67 which is caused by the vibration of the bobbin main portion 65 can be stabilized.

Still furthermore, in this embodiment, the connector 69 for connecting the audio signal processing circuit board 32 is made to act as the movement fulcrum, so that the circuit board side connector 72 of the audio signal processing circuit board 32 can be easily connected to the connector 69.

Still furthermore, in this embodiment, the cutout portions 68 are formed by cutting out both the sides of the base portion 67*a* of the signal line portion 67, and the signal line portion 67 is bent from the cutout portions 68 so as to extend at the back side of the diaphragm 24. Accordingly, the signal line portion 67 can be made to extend at the back side of the diaphragm 24 with a simple construction of forming the cutout portions 68 in the bobbin main portion 65. Therefore, the deterioration of the sound quality can be suppressed without greatly increasing the number of manufacturing steps.

Second Embodiment

Next, a second embodiment of the present invention will be described with reference to FIG. 8.

Figure 8:
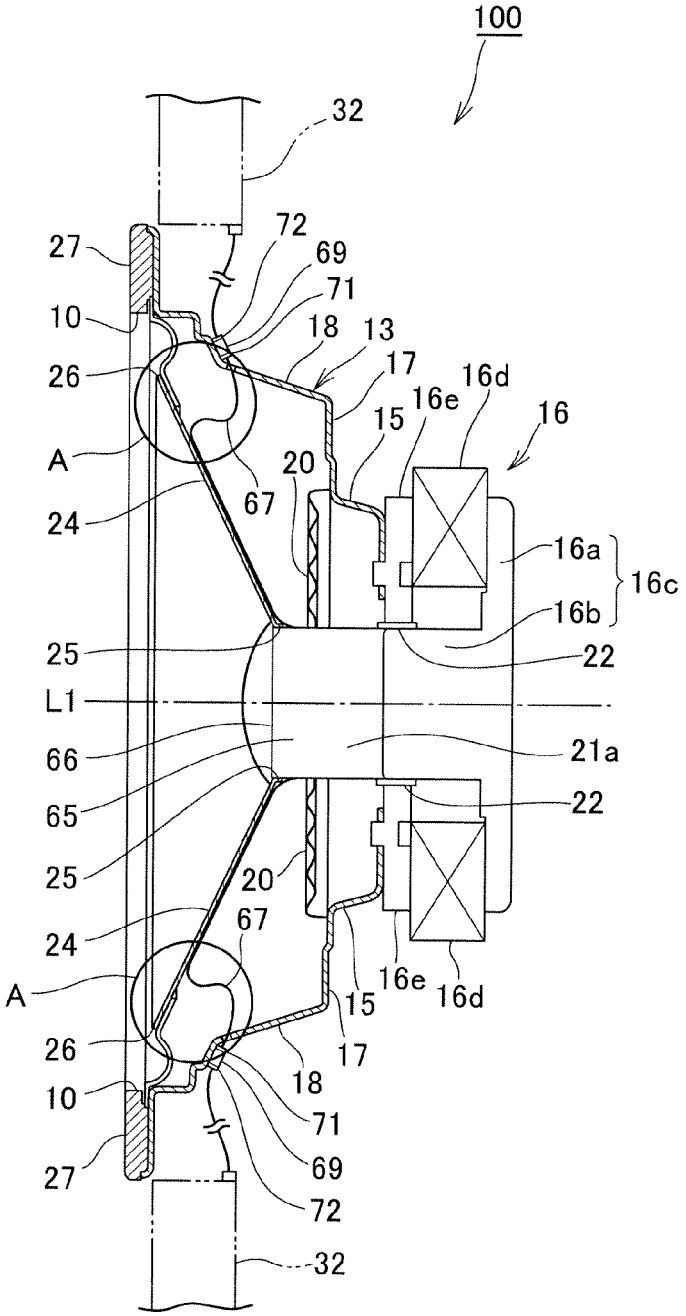
FIG. 8 is a cross-sectional view showing a voice coil speaker according to a second embodiment of the present invention.

FIG. 8 is a cross-sectional view showing a voice coil speaker 100 according to a second embodiment.

In the following description, the same constituent elements as the first embodiment described above are represented by the same reference numerals, and the descriptions thereof are omitted.

In the first embodiment, the signal line portion 67 is separated from the diaphragm 24. However, in the second embodiment, the signal line portion 67 is fixed to the diaphragm 24. Specifically, the signal line portion 67 which is bent from the cutout portions 68 is fixed along the diaphragm 24 from the vicinity of the base end portion 25 of the diaphragm 24 to the vicinity of the connector 69. In this embodiment, the signal line portion 67 and the diaphragm 24 are fixed to each other with adhesive material, but the fixing means for the signal line portion 67 and the diaphragm 24 is not limited to the adhesive material. The signal line portion 67 of this embodiment is provided with a slack portion (allowance portion) associated with the stroke amount of the bobbin 21*a* at the signal line connector 71 side, thereby preventing smooth vibration of the bobbin 21*a* from being disturbed by the signal line portion 67.

By fixing the signal line portion 67 along the back surface of the diaphragm 24 as described above, the moving portion (slack portion) of the signal line portion 67 can be minimized as shown by a range A in FIG. 8. The weight of the signal line portion 67 is hardly imposed on the bobbin main portion 65, so that the signal line portion 67 can be surely prevented from disturbing the vibration of the bobbin main portion 65, and thus the deterioration of the sound quality can be effectively prevented. Furthermore, the signal line portion 67 is formed of a thin flat plate, so that the signal line portion 67 can be easily made to adhere to the diaphragm 24.

Third Embodiment

Next, a third embodiment will be described with reference to FIGS. 9 and 10.

Figure 9:
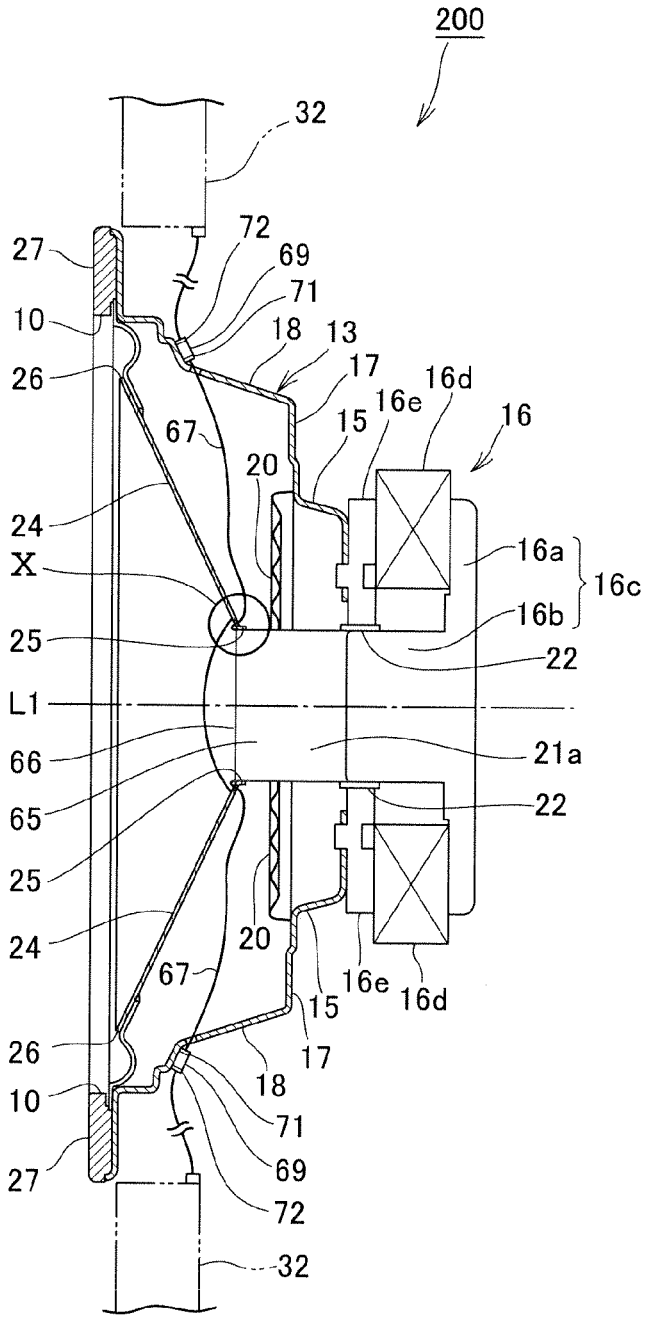
FIG. 9 is a cross-sectional view showing a voice coil speaker according to a third embodiment of the present invention.
Figure 10:
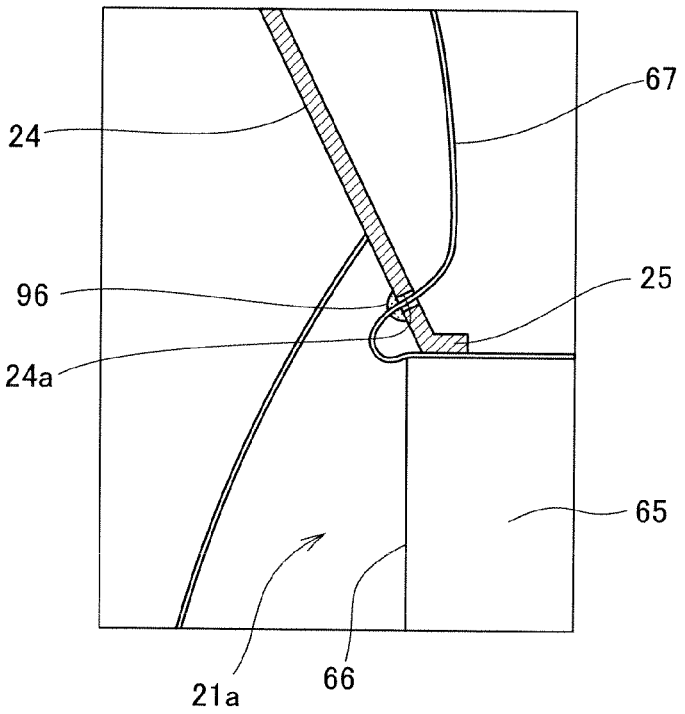
FIG. 10 is a main-part enlarged view showing an enlarged range X-X of FIG. 9.

FIG. 9 is a cross-sectional view showing a voice coil speaker 200 according to a third embodiment of the present invention, and FIG. 10 is a main-part enlarged view showing an enlarged range X-X of FIG. 9.

In the following description, the same constituent elements as the first embodiment described above are represented by the same reference numerals, and the descriptions thereof are omitted.

In the first embodiment, the cutout portions 68 are formed on the bobbin main portion 65. However, in the third embodiment, the cutout portions 68 are not formed on the bobbin main portion 65.

As shown in FIGS. 9 and 10, through-holes 24*a* through which the signal line portions 67 penetrate respectively are formed at symmetrical positions with respect to the center axis L1 in connection with the respective signal line portions 67 in the diaphragm 24. These through-holes 24*a* are formed in the neighborhood of the base end portion 25 of the diaphragm 24. Since the through-holes 24*a* are formed in the neighborhood of the connection portion between the diaphragm 24 and the bobbin 21*a* as described above, the influence of the through-holes 24*a* on the vibration of the diaphragm 24 can be minimized.

The signal line portion 67 is placed to penetrate from the front side of the diaphragm 24 through the through-holes 24*a*, and led to the back side of the diaphragm so that the signal line portion so as to extend at the back side of the diaphragm 24. The signal line portion 67 is fixed to the diaphragm 24 in the through-hole 24*a* by fixing means 96 such as adhesive agent or the like, and the signal line connector 71 is connected to the connector 69, whereby the signal line portion 67 is fixed to the speaker frame 13.

As described above, according to this embodiment, the through-holes 24*a* are formed in the diaphragm 24, and the signal line portions 67 are made to penetrate from the front side of the diaphragm 24 through the through-holes 24*a* to the back side of the diaphragm 24 so as to extend at the back side of the diaphragm 24. Therefore, it is unnecessary to form the cutout portions on the bobbin main portion 65, and thus the manufacturing can be simplified. Furthermore, it is unnecessary to wind the reinforcing member around the bobbin main portion 65, so that the easiness of the manufacturing process can be enhanced and the number of parts can be reduced. Still furthermore, the bobbin conductors 75 can be formed at areas where cutout portions are formed, so that the degree of freedom of design for the bobbin conductors 75 can be enhanced.

Fourth Embodiment

Next, a fourth embodiment will be described with reference to FIG. 11.

Figure 11:
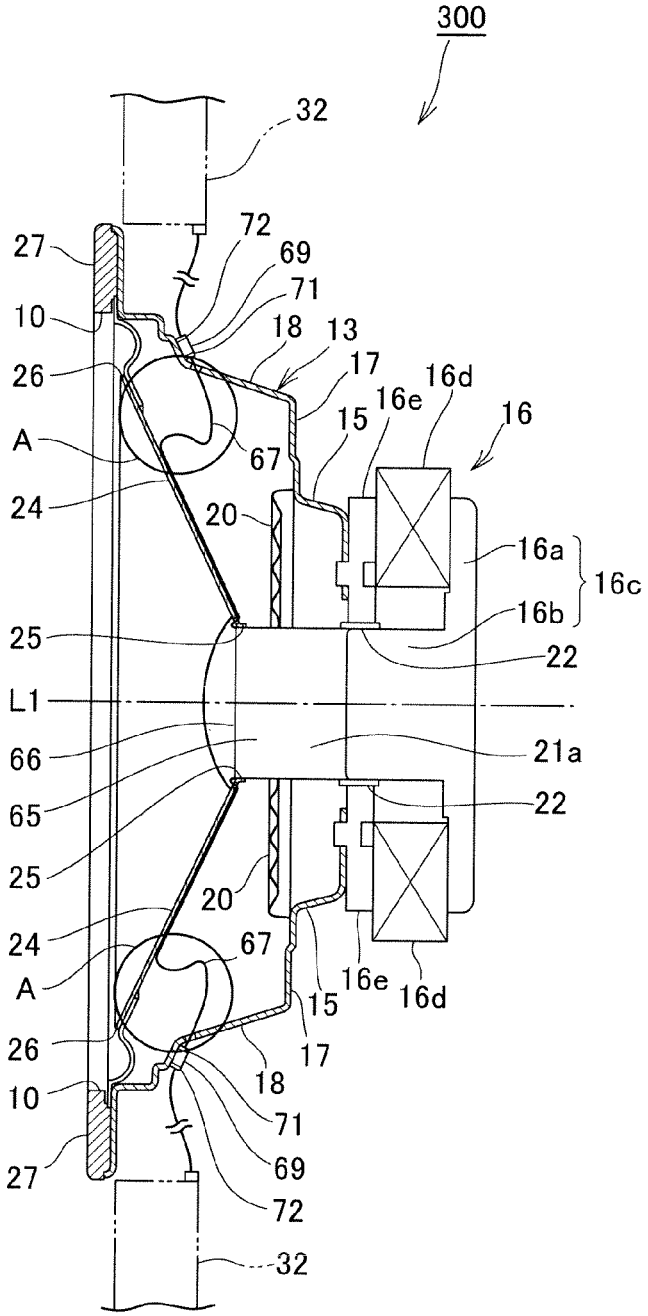
FIG. 11 is cross-sectional view of a voice coil speaker according to a fourth embodiment of the present invention.

FIG. 11 is a cross-sectional view showing a voice coil speaker 300 according to a fourth embodiment.

In the following description, the same constituent elements as the third embodiment described above are represented by the same reference numerals, and the descriptions thereof are omitted.

In the third embodiment, the signal line portions 67 are separated from the diaphragm 24. However, in the fourth embodiment, the signal line portions 67 are fixed to the diaphragm 24 as in the case of the second embodiment. Accordingly, the moving portions (slack portions) of the signal line portions 67 can be minimized as in the case of the second embodiment as shown by a range A in FIG. 11. Therefore, the weight of the signal line portion 67 is hardly imposed on the bobbin main portion 65, so that the signal line portion 67 can be surely prevented from disturbing the vibration of the bobbin main portion 65, and the deterioration of the sound quality can be prevented. Furthermore, since the signal line portion 67 is formed like a thin flat plate, the signal line portion 67 can be easily adhesively attached to the diaphragm 24.

Fifth Embodiment

Next, a third embodiment will be described with reference to FIG. 12.

Figure 12:
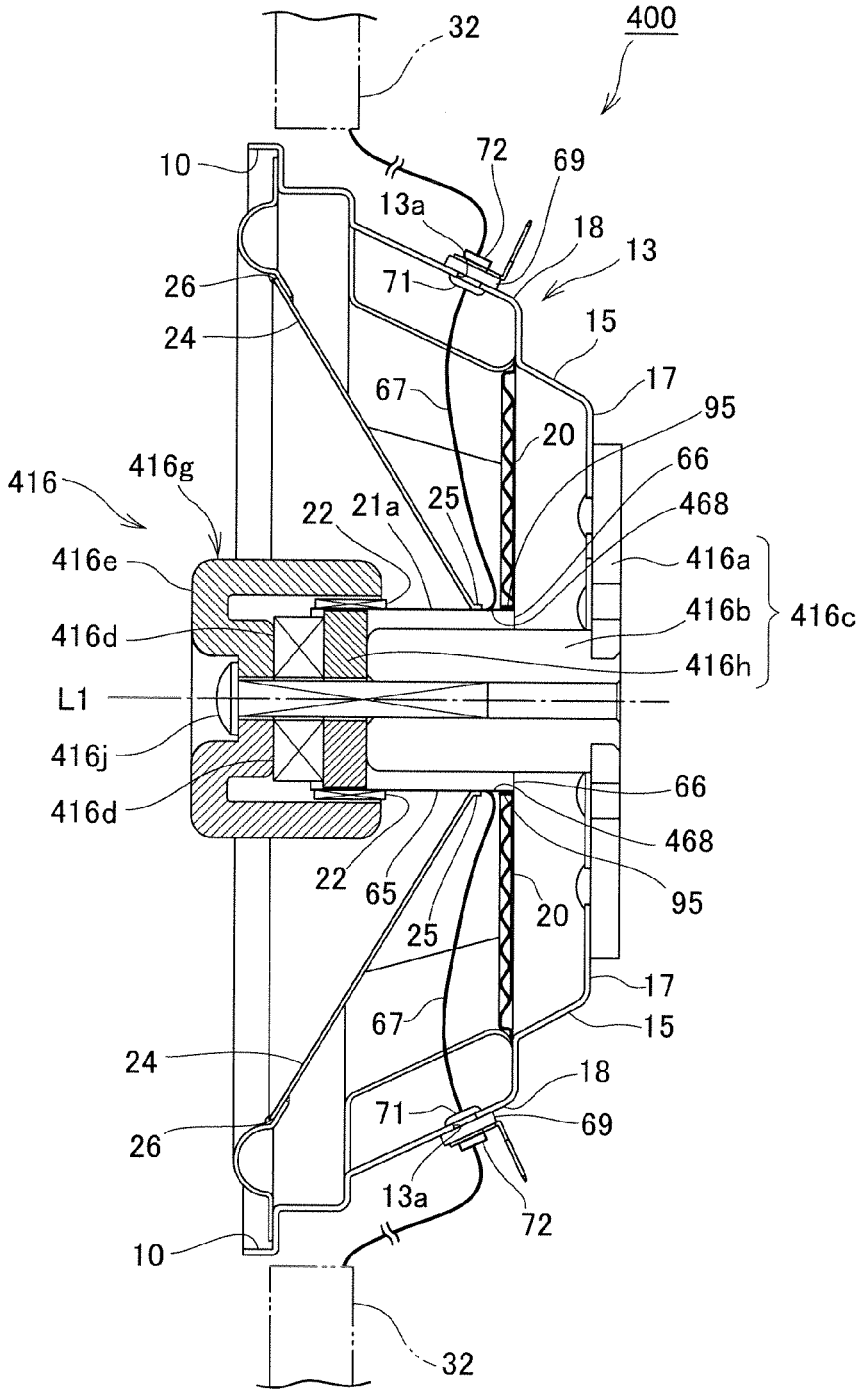
FIG. 12 is a cross-sectional view showing a voice coil speaker according to a fifth embodiment of the present invention.

FIG. 12 is a cross-sectional view showing a voice coil speaker 400 according to a fifth embodiment.

In the following description, the same constituent elements as the first embodiment described above are represented by the same reference numerals, and the descriptions thereof are omitted.

In the first embodiment, the magnetic circuit unit 16 is equipped at the back side of the diaphragm 24. However, in the fifth embodiment, a driving portion 416*g* of a magnetic circuit unit 416 is equipped at the front side of the diaphragm 24. In this embodiment, the frame flange 27 is omitted.

The magnetic circuit unit 416 has a yoke 416*c* comprising a disc-shaped yoke bottom portion 416*a*, a cylindrical yoke projecting portion 416*b* which protrudes ahead of the diaphragm 24 at the center portion of the yoke bottom portion 416*a*, and a yoke main body 416*h* disposed at the front end of the yoke projecting portion 416*b*. An annular magnet 416*d* is fixed to the front surface of the yoke main body 416*h*, and the yoke main body 416*h* and the magnet 416*d* are surrounded by a cylindrical cylinder body 416*e* having a bottom at the front surface of the yoke main body 416*h*. The yoke main body 416*h*, the magnet 416*d* and the cylinder body 416*e* constitutes the driving portion 416*g* of the magnetic circuit unit 416. The driving portion 416*g* is positioned at the front side of the diaphragm 24 so that the center axis thereof is coincident with the center axis L1 of the voice coil speaker 400, and then fixed to the yoke projecting portion 416*b* with a bolt 416*j*. As described above, in this embodiment, the driving portion 416*g* of the magnetic circuit unit 16 is disposed in front of the diaphragm 24, thereby effectively using the space formed in front of the diaphragm 24.

The bobbin 21*a* and the voice coil 22 formed by winding tinsel (lead wire) around the bobbin 21*a* are disposed between the outer periphery of the yoke main body 416*h* and the inner periphery of the cylinder body 416*e*. The bobbin 21*a* is supported at the tip 66 side of the bobbin main portion 65 by a damper 20, and the diaphragm 24 is supported by the bobbin main portion 65 at a position which is nearer to the center in the axial direction than the tip 66 of the bobbin main portion 65. The length of the cutout portions 468 of the bobbin main portion 65 is set to a predetermined length which enables the signal line portions 67 to avoid the connection portion between the damper 20 and the bobbin main portion 65. Accordingly, the bobbin main portion 65 is supported by the damper 20 under the state that the signal line portions 67 are bent from the cutout portions 468 to the outside of the bobbin main portion 65, whereby the signal line portions 67 are placed to extend at the back side of the diaphragm 24. In this embodiment, it is unnecessary to dispose the audio signal processing circuit board 32 in front of the diaphragm 24 as in the case of the first embodiment, and thus the deterioration of the sound quality can be prevented.

Furthermore, a reinforcing member 95 is wound in the peripheral direction of the bobbin main portion 65 over at least a range where the cutout portions 468 are formed. By winding the reinforcing member 95 around the bobbin main portion 65 as described above, the tip 66 side of the bobbin main portion 65 which is liable to be deformed due to formation of the cutout portions 468 is reinforced, so that the circular shape of the bobbin main portion 65 can be stabilized. Accordingly, the vibration of the bobbin 21*a* is smoothly transmitted to the diaphragm 24, so that the deterioration of the sound quality caused by the formation of the cutout portions 468 can be suppressed.

In this embodiment, the signal line portion 67 is made to extend between the diaphragm 24 and the damper 20. However, when the signal line portion 67 is made to extend at the back side of the damper 20, it is unnecessary to form the cutout portions 468, and thus the reinforcing member 95 is also unnecessary.

The connector 69 is equipped at the outside of the frame cylinder portion 18 so that the connection portion thereof to the signal line connector 71 is exposed from the insertion hole 13*a* of the speaker frame 13.

The above embodiments are examples of the present invention, and any modification and application may be made within the scope of the present invention.

For example, in the above embodiments, voice coils 22 of six layers are formed on the bobbin 21*a*, but the number of the layers of the voice coils 22 is not limited to this number. That is, the present invention is broadly applicable to a voice coil speaker 1 in which one or plural layers of voice coils 22 are formed on a bobbin 21*a*.

Furthermore, in the above embodiments, the signal line portion 67 is placed to extend between the diaphragm 24 and the damper 20. However, the present invention is not limited to this style, and the signal line portion 67 may be placed to extend at the back side of the diaphragm 24.

In the above embodiments, the signal line connector 71 for the signal line portion 67 and the circuit board side connector 72 for the audio signal processing circuit board 32 are connected to each other through the connector 69. However, the signal line connector 71 and the circuit board side connector 72 may be directly connected to each other without the connector 69. In this case, at Least one of the signal line connector 71 and the circuit board side connector 72 is fixed to the speaker frame 13, and the fixed connector serves as a fulcrum for movement of the signal line portion 67.

Figure 13:
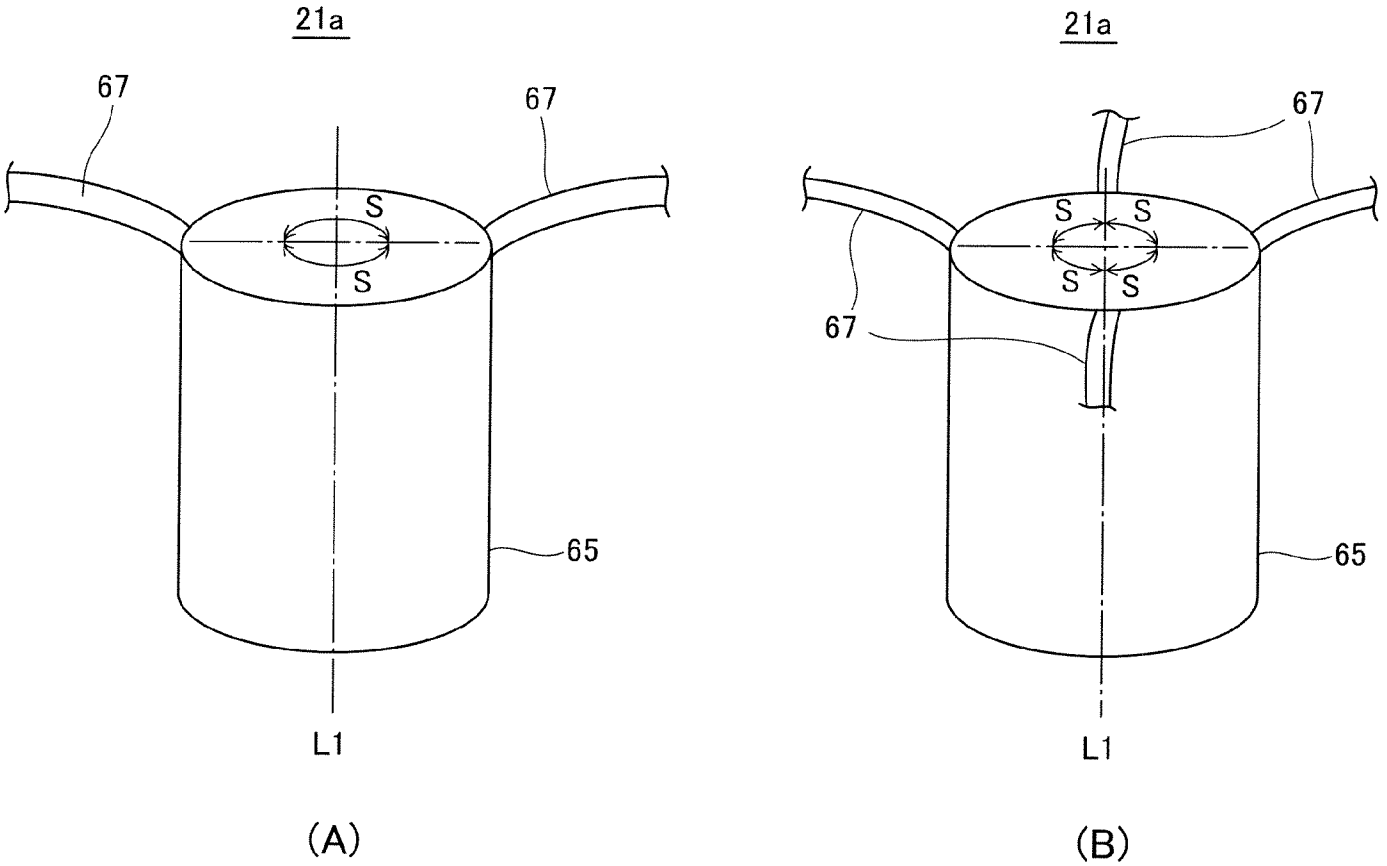
FIG. 13 is a Perspective view showing a bobbin, wherein (A) shows the bobbin having two signal line portions, and (B) shows the bobbin having four signal line portions.

In the above embodiments, the two signal line portions 67 are equipped. However, one signal line portion 67 or plural (three or more) signal line portions 67 may be equipped. When plural signal line portions 67 are equipped, as shown in FIG. 13, it is desired that the plural signal line portions 67 are arranged at symmetrical positions with respect to the center axis L1 of the bobbin 21*a*, in other words, at equidistance intervals S in the peripheral direction of the cylindrical bobbin main portion 65. Accordingly, the force from the signal line portions 67 is substantially equally applied to the bobbin main portion 65, and deviated load is hardly applied to the bobbin main portion 65, so that the bobbin main portion 65 vibrates smoothly, and the sound quality can be prevented from being deteriorated by the signal line portions 67. When the number of the signal line portions 67 is odd, it is impossible to arrange the signal line portions 67 at the symmetrical positions with respect to the center axis L1 of the bobbin 21*a*, and thus they may be arranged at equidistance intervals S in the peripheral direction of the bobbin main portion 65.

As the number of the signal line portions 67 increases, the width of each signal line portion 67 can be reduced, so that bendability and flexibility of the signal line portions 67 can be more greatly secured. In addition, the a linear site 65*a* of the bobbin main portion 65 becomes small, and the rolled bobbin main portion 65 can be made closer to a true circle. Therefore, the vibration of the bobbin 21*a* can be transmitted to the diaphragm 24 (FIG. 1, etc.) substantially equally in the peripheral direction, and the deterioration of the sound quality can be prevented.

In the above embodiments, the voice coil speaker and the audio signal processing circuit board 32 are configured to be separated from each other, and the audio signal processing circuit board 32 is connected to the voice coil speaker. However, the voice coil speaker may be configured to contain the audio signal processing circuit board 32.

In the above embodiments, the voice coil speaker 1 is mounted in a vehicle. However, the voice coil speaker 1 is not limited to an in-vehicle mount voice coil speaker.

DESCRIPTION OF REFERENCE NUMERALS

1, 100, 200, 300, 400 voice coil speaker
13 speaker frame (frame)
21*a* bobbin
22 voice coil
24 diaphragm
24*a* through-hole
32 audio signal processing circuit board (circuit board)
65 bobbin main portion
66 tip
67 signal line portion (extension portion)
67*a* base portion
68, 468 cutout portion
69 connector (fulcrum for movement)
71 signal line connector (fulcrum for movement)
95 reinforcing member
L1 center axis
S equidistance interval

The invention claimed is:

1. A voice coil speaker comprising:
a diaphragm supported by a frame; and
a bobbin that is connected to the diaphragm and has voice coils formed thereon, wherein:
the bobbin has a bobbin main portion that is formed of a flexible printed board and that has the voice coils wound therearound, and an extension portion that is integrally formed with the bobbin main portion, extends from a part of the flexible printed board, and has signal lines conducted to the voice coils,
cutout portions are formed at both sides of a base portion of the extension portion, and
the extension portion is placed to extend at a back side of the diaphragm in a state that a part of the bobbin main portion which is surrounded b the cutout portions is raised from the bobbin main portion.

2. The voice coil speaker according to claim 1, wherein a fulcrum for movement of the extension portion is disposed at the frame, and the extension portion that is placed to extend at the back side of the diaphragm is connected to the fulcrum for movement.

3. The voice coil speaker according to claim 2, wherein the fulcrum for movement is a connector for connection of a circuit board that processes audio signals.

4. The voice coil speaker according to claim 1, wherein a reinforcing member is equipped at a site corresponding to at least the cutout portions of the bobbin main portion.

5. The voice coil speaker according to claim 1, wherein the extension portion is fixed along a back surface of the diaphragm.

6. The voice coil speaker according to claim 1, wherein a plurality of extension portions are equipped, and the plurality of extension portions are equipped at symmetrical positions with respect to a center axis of the bobbin.

7. The voice coil speaker according to claim 1, wherein a plurality of extension portions are equipped, and the plurality of extension portions are equipped at equidistance intervals in the peripheral direction of the bobbin.

8. The voice coil speaker according to claim 1, wherein the extension portion is equipped with a shield.

* * * * *